United States Patent [19]

Schmitt et al.

[11] 4,436,195

[45] Mar. 13, 1984

[54] MULTI-COIN CHUTE MECHANISM

[75] Inventors: Donald C. Schmitt, Lithonia; Melvin J. Harvill, Conyers, both of Ga.

[73] Assignee: Reed Industries, Inc., Stone Mountain, Ga.

[21] Appl. No.: 274,878

[22] Filed: Jun. 18, 1981

[51] Int. Cl.[3] ..... G07F 5/02

[52] U.S. Cl. ..... 194/92; 194/1 G

[58] Field of Search ..... 194/1 G, 92, 93, DIG. 2

[56] References Cited

U.S. PATENT DOCUMENTS

| | | | |
|---|---|---|---|
| 673,800 | 5/1901 | Romans et al. | 194/93 |
| 764,818 | 7/1904 | McMillan | 194/93 |
| 1,908,380 | 5/1933 | Tratsch | 194/92 |
| 2,038,837 | 4/1936 | Goetz | 194/92 X |
| 3,265,179 | 8/1966 | Luke | 194/92 |
| 4,197,932 | 4/1980 | Mercurio | 194/92 |
| 4,221,285 | 9/1980 | Greenwald et al. | 194/1 G |

*Primary Examiner*—F. J. Bartuska

*Attorney, Agent, or Firm*—Jones & Askew

[57] ABSTRACT

An improved coin chute is disclosed which incorporates a diameter gauging dog which is capable of tilting and lateral shifting whereby it actively seeks out a peripheral gap in a coin socket created by an undersize coin and penetrates deeply into said socket so as to arrest movement of the coin chute slide. Also disclosed is a novel arrangement of coin tilting mechanism and an abutment member which cooperatively operate to prevent further forward motion of the slide, or to strip a coin from a strip of tape intended to defeat the discharge or depositing of the coin and thereby permit retrieval of the coin by the user.

5 Claims, 7 Drawing Figures

MULTI-COIN CHUTE MECHANISM

BACKGROUND OF THE INVENTION

In coin chute mechanisms, a number of coin sensing devices are necessary in order to assure that the coin slide cannot be pushed fully in unless the correct coin or coins are deposited. Among these sensing devices are so-called gauging dogs whose purpose is to detect the diameter of a deposited coin and prevent operation of the mechanism when a coin or the like which of too small diameter is detected. Basically, such gauging devices are in the form of levers pivotally mounted and spring biased such that a tip portion thereof may drop into the peripheral gap or space created in the coin socket by an undersize coin or bogus token as the coin slide is slid inwardly toward its operative position. In order to assure accuracy of gauging, the lever is so located that its tip describes a path of movement, relative to the slide, which intersects the coin socket nearly tangentially. In this way, even a slightly undersize bogus coin or token may be detected. However, since a bogus coin can be deposited in the coin socket so that it effectively fills the space "detected" by the tip of such dog, it is common practice to provide two dogs the respective tips of which intersect essentially tangentially with the opposite sides of the coin socket, see for example the Tratsch U.S. Pat. Nos. 1,908,380 of May 9, 1933 and 1,941,638 of Jan. 2, 1934.

Another problem involving gauging dogs is that which is encountered in those mechanisms where the denomination (and therefore diameter) of coin (or coins) may be changed to accommodate for future increase in price or cost of the goods or services provided by the structure with which the coin chute is associated. See, for example, Greenwald et al U.S. Pat. No. 4,221,285, Sept. 9, 1980. In this environment, plural gauging dogs have been required, one for each of the different diameter of the coin sockets which may be used, or if a single dog is employed, it has required complex structure which allows the dog to be adjusted in position dependent upon the size of coin socket in use, see Greenwald U.S. Pat. No. 3,763,984 of Oct. 9, 1973.

The use of coin sensing devices, including gauging dogs as above mentioned, is of course necessitated by the unfortunate fact that some users will attempt to defeat the coin chute mechanism. So-called ring dogs usually are employed to detect the presence of a washer in the coin socket. Also, it is not uncommon to employ a magnet to frustrate the user who attempts to use ferrous slugs having the proper thickness and diameter of the coin or coins to be used. Another way in which users attempt to defeat the mechanism is to use adhesive tape over the proper coin or coins to prevent the coins from dropping into the deposit box when the coin slide is pushed in, thereby to retrieve the coin or coins when the slide is returned to its outer or "start" position.

BRIEF SUMMARY OF THE INVENTION

As noted above, the diameter gauging dogs of the prior art require rather precise positioning in order effectively to operate to limit or arrest the motion of the coin slide and, moreover, such devices when used with coin slides which are adapted or can be adapted to transport different sizes or diameters of coins have required either a pair of gauging dogs, one for each coin socket diameter size, or they have required complex mounting mechanism to allow adjustability of a single dog mechanism. Consequently, a principal feature of the present invention is to provide an improved coin diameter gauging dog which is uniquely mounted for tilting and swinging or lateral shifting motion so that the operative tip thereof actively seeks out and penetrates deeply into any peripheral gap in a coin socket created by the presence of an undersize coin therein. The great flexibility provided by this arrangement allows the use of but a single dog, without adjustment, to accommodate for different sizes of coin sockets and thereby allows the use of coin slides having knock-out portions which accommodate for the total value of the coins transported by the slide in use, and will also have the ability to penetrate the holes in some washers which may have passed the ring dogs.

Another feature of the present invention is the provision of means to frustrate the use of tape strips intended to defeat the coin chute assembly be retaining the coins within the coin socket at the discharge station for the coins and thereby allowing the coins to be retrieved when the coin slide is moved back to its initial position. Basically, this arrangement according to the present invention utilizes a spring biased member which tilts a coin downwardly in the coin socket at the discharge position of the coin and, in conjunction therewith, an upwardly biased abutment member or finger positioned to engage behind the so-tilted coin so that as the coin slide is moved toward its initial position (at which a successfully taped coin could normally be retrieved), the coins either will be stripped from the tape and will drop into the deposit box of the vending or other machine with which the coin chute mechanism is associated, or will jam the chute and prevent further operation, thus discouraging taping the coins.

BRIEF DESCRIPTION OF THE DRAWING FIGURES

DETAILED DESCRIPTION OF THE INVENTION

Figure 1:
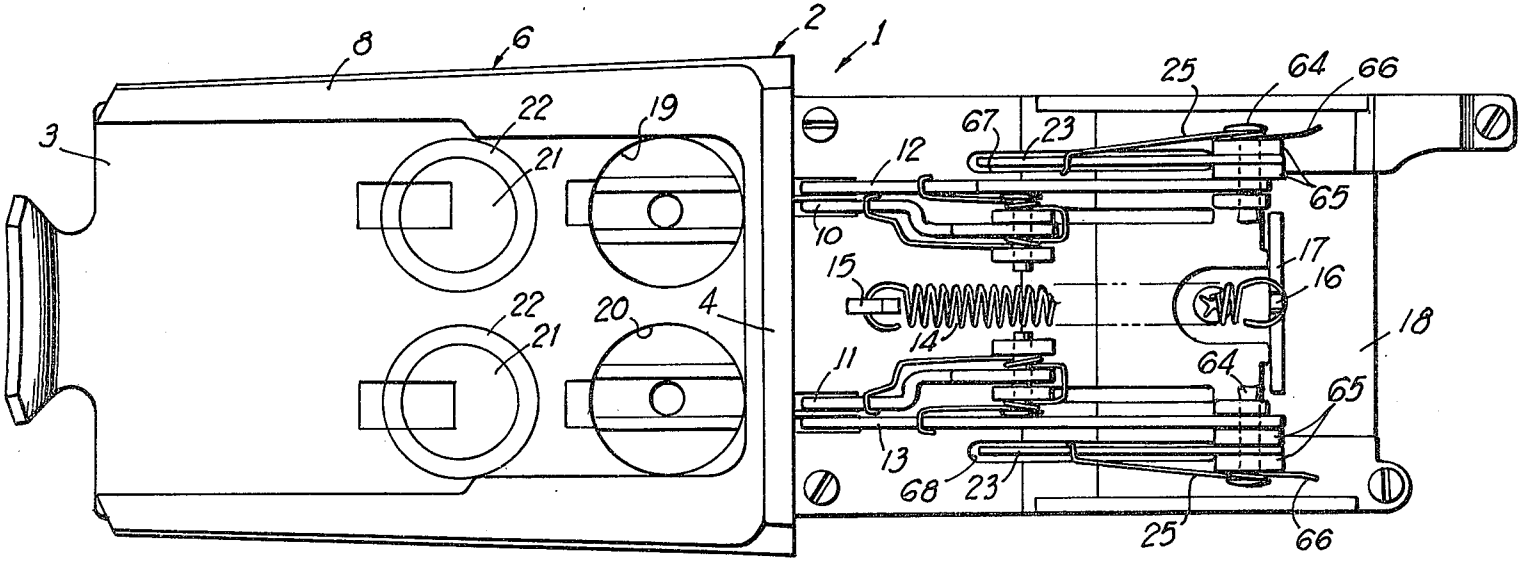
FIG. 1 is a top plan view of the improved coin chute assembly in accord with the present invention.

Referring initially to FIG. 1, a coin chute mechanism of generally conventional construction is indicated therein generally by the reference character 1 which includes, as is conventional, a frame indicated generally by the reference character 2 which slidably mounts the coin slide indicated by the reference character 3. The frame 2 is provided with the flanges 4 and 5 as is clearly illustrated in FIG. 2 which provide ready means for attaching the coin chute assembly to a vending machine or the like with which it is to be associated. The outer portion of the frame as is indicated generally by the reference character 6 includes the lateral side pieces 7 and 8 which provide rails or guides receiving the opposite edges of the slide 3 and the coin chute mechanism as is also conventional provides, in the region of the flanges 4 and 5, an opening through which the slide snugly projects.

The inner side of the mechanism as indicated generally by the reference character 9 is, as is conventional, disposed within the interior of the vending or like machine with which it is associated and therefore is not accessible to the user. FIG. 1 illustrates two conventional dog assemblies which normally are associated with coin chute assemblies. These are the so-called ring dogs indicated by the reference characters 10 and 11 and the so-called thickness gauging dogs indicated by the reference characters 12 and 13. These dogs are entirely conventional in nature and do not form part of the present invention and they are therefore not described with further particularity.

As is conventional also, the coin chute assembly is provided with a return spring device indicated by the reference character 14 which is anchored at one end, as at the lug 15 carried by the frame 2 and at the post 16 at its opposite end carried by an upright member 17 affixed to the inner end 18 of the coin slide 3. It will be appreciated that as is conventional also, the frame provides a floor or surface beneath the coin slide 3 which cooperates with openings such as those indicated at 19 and 20 to define coin-receiving sockets. In the slide illustrated, there are also provided secondary potential coin socket openings in the slide 3 but which are illustrated as being closed by the respective knock-out portions 21 and 22. This is also conventional and it is to be understood that the socket openings 19 and 20 may also initially be provided with such knock-outs. This allows the coin chute mechanism to be utilized initially to require the depositing of different diameter and therefore different value coins, the openings 19 and 22 as illustrated being sized to accept quarters. The knock-outs 21 are sized to provide dime sockets when knocked-out and the outer knock-out portions 22 are sized to provide the quarter sockets.

It will further be appreciated that the coin chute mechanism is conventionally formed with the usual pawl and rachet mechanism which constrains the user to push the coin slide fully into the machine-actuating position once it has passed a partially inwardly slid position, the pawl and rachet mechanism being reset in the inwardmost position of the slide to allow complete withdrawal thereof thereafter.

Figure 2:
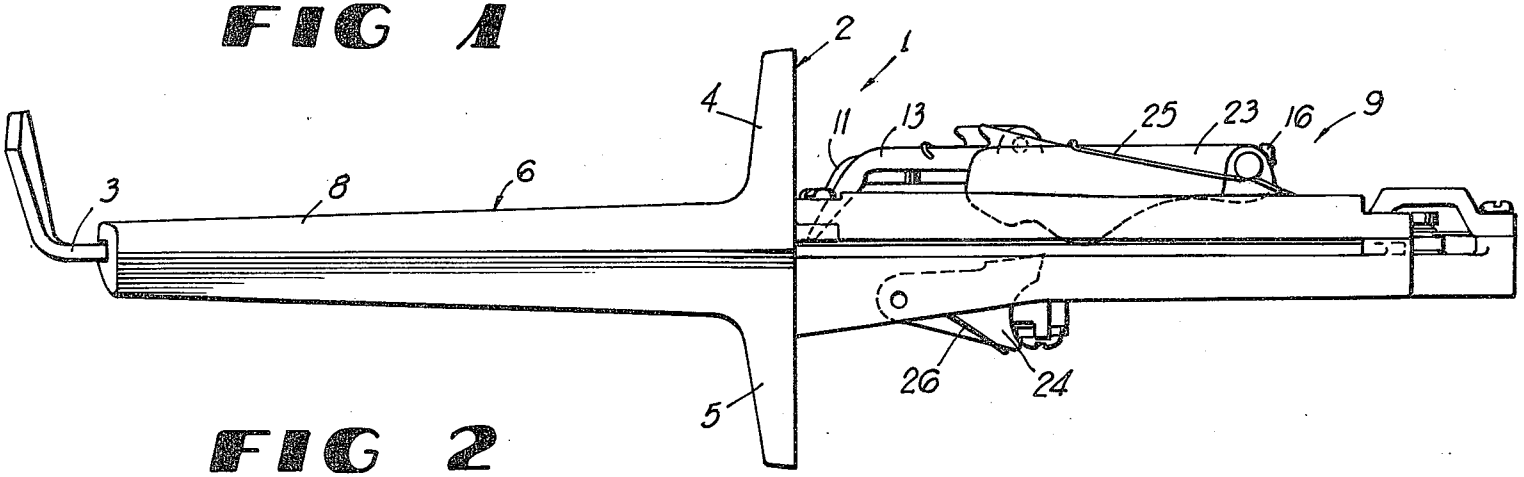
FIG. 2 is a side elevational view of the assembly shown in FIG. 1.

FIG. 2 illustrates generally the relative positions of the coin tilting dog 23 and the abutment dogs 24, the former having a spring biasing member 25 and the latter having spring biasing members 26 hereinafter more fully described.

Figure 3:
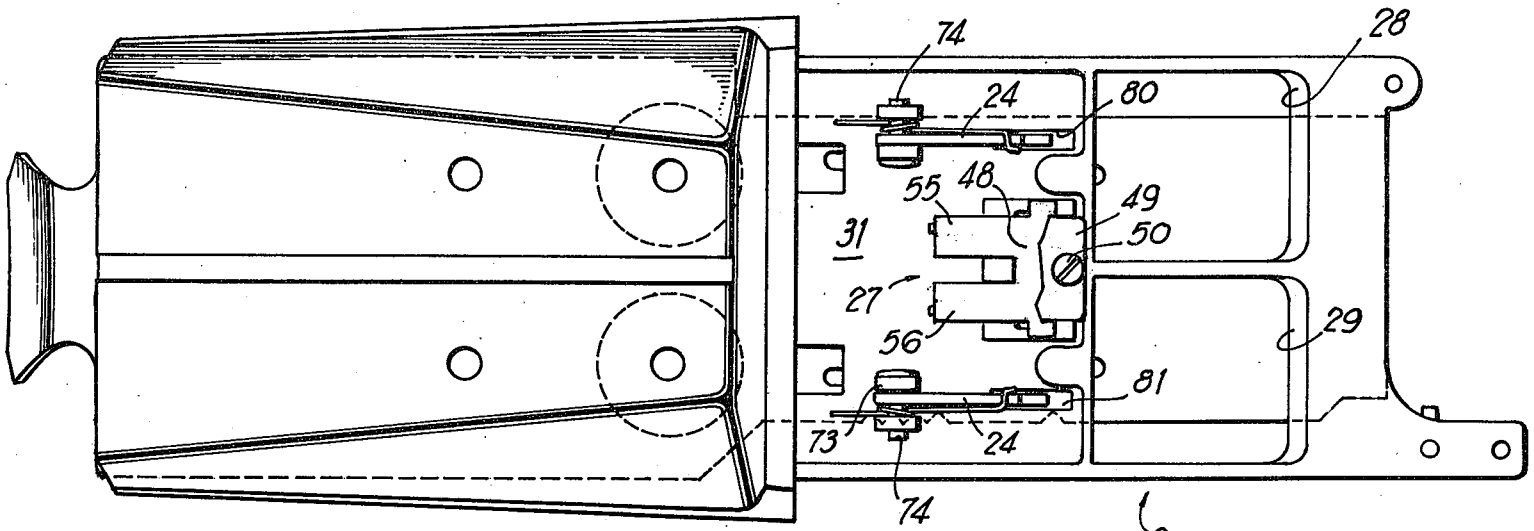
FIG. 3 is a bottom plan view of the coin chute assembly.

FIG. 3 which illustrates the underside of the coin chute mechanism more clearly illustrates the disposition of the two abutment dogs 24 and of the diameter gauging dog assembly indicated generally by the reference character 27. FIG. 3 also illustrates the coin discharge openings 28 and 29 which are disposed, as is conventional, in the frame at the discharge position for the coins as transported by the coin slide 3.

Figure 5:
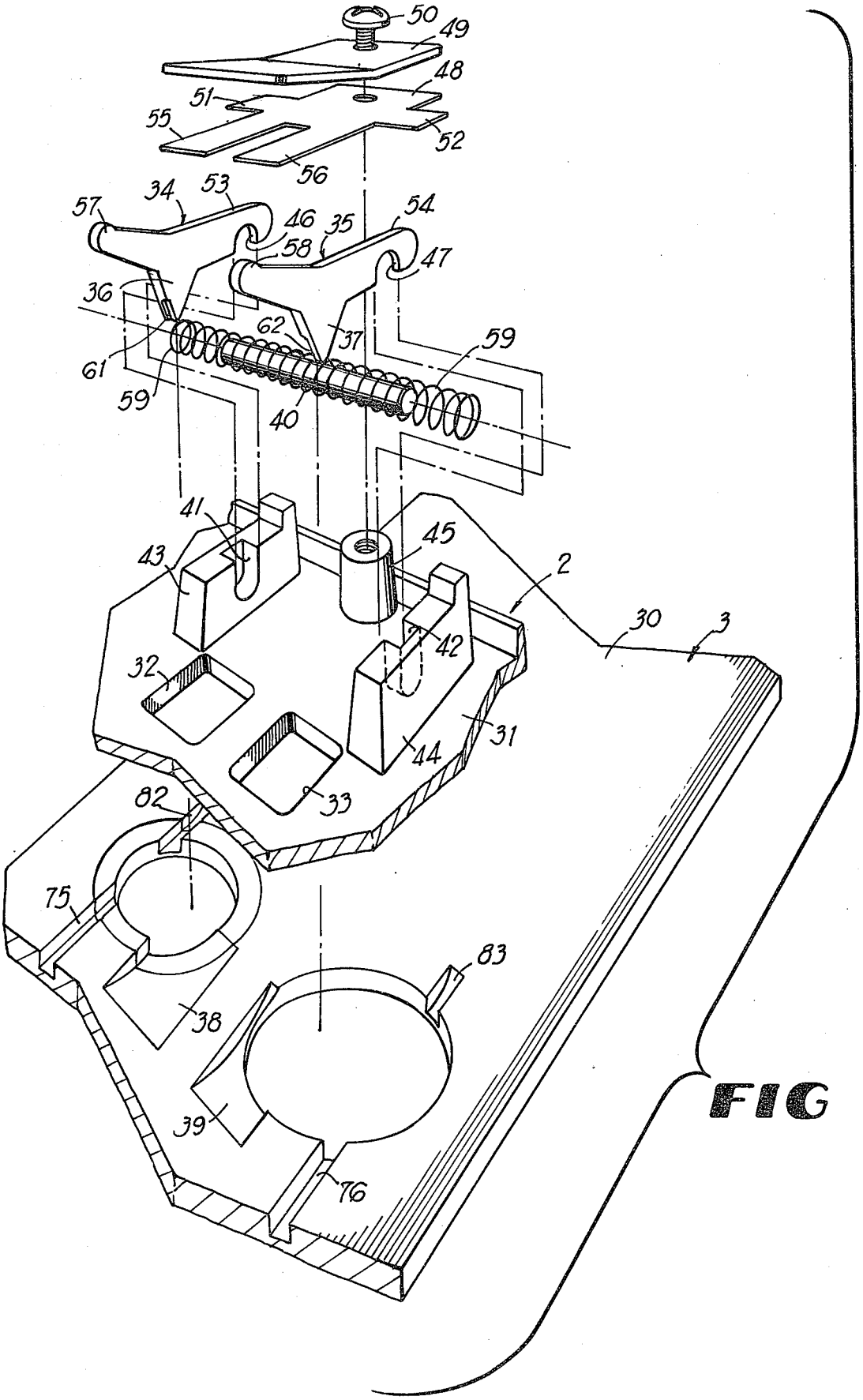
FIG. 5 is an exploded perspective view illustrating the improved diameter gauging mechanism.

Referring for the moment to FIG. 5, the bottom side 30 of the coin slide is illustrated therein as well as a portion 31 of the floor of the frame 2. As illustrated, the portion 31 is provided with a pair of openings 32 and 33 which are provided to allow the gauging dogs 34 and 35 and more especially their generally V-shaped tips 36 and 37 respectively to penetrate through these openings 32 and 33 against the bottom surface 30 of the coin slide. The bottom surface 30 of the coin slide is provided with the ramps or bevels 38 and 39 which are, in general, in alignment with the tips 36 and 37 of the dogs 34 and 35. In order to mount the dogs 34 and 35, an anchor pin 40 is provided, the opposite ends of which are seated within the recesses 41 and 42 of a pair of abutment members 43 and 44 affixed to the underside of the floor 31 of the frame 2, as illustrated. The two dogs 34 and 35 are provided with notches 46 and 47 which allow them to be loosely engaged over the anchor pin 40. The spring plate 48 and the backing plate 49 are secured to the mounting post 45 by means of a suitable fastening element 50 so that the spring plate 48, and particularly the side wings 51 and 52 thereof bear upon the upper surface portions 53 and 54 of the respective dogs and resiliently urge them downwardly into their loose anchoring arrangement and engagement with the pin 40.

The forward wings 55 and 56 of the spring plate bear upon the forward end portions 57 and 58 of the dogs 34 and thereby urge their respective tips 36 and 37 upwardly through openings 32 and 33 and into engagement with the undersurface 30 of the coin slide 3. Lastly, a coil spring 59 is disposed in surrounding relationship to the pin 40 and bears respectively at its opposite ends against the inner sides of the two gauging dogs 34 and 35, thus normally to urge the dogs outwardly into engagement with the inner sides of their respective abutment members 43 and 44 so that, as is shown more clearly in FIG. 6, each of these dogs and more especially their tips, are disposed in an essentially upright or generally vertical plane whereby the tips engage the undersurface 30 of the coin slide along a line, as the coin slide is moved from its outermost to its innermost position which lie between the widthwise confines of the paths of the respective coin sockets.

Figure 6:
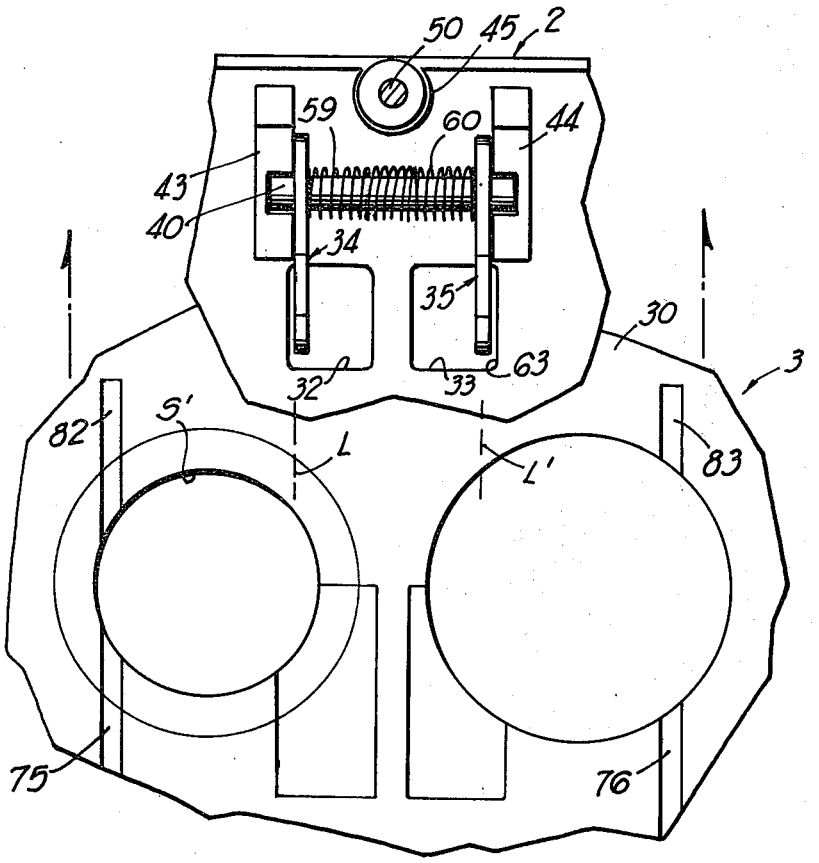
FIGS. 6 and 7 are partial bottom plan views which illustrate the operation of the diameter gauging dog mechanism.
Figure 7:
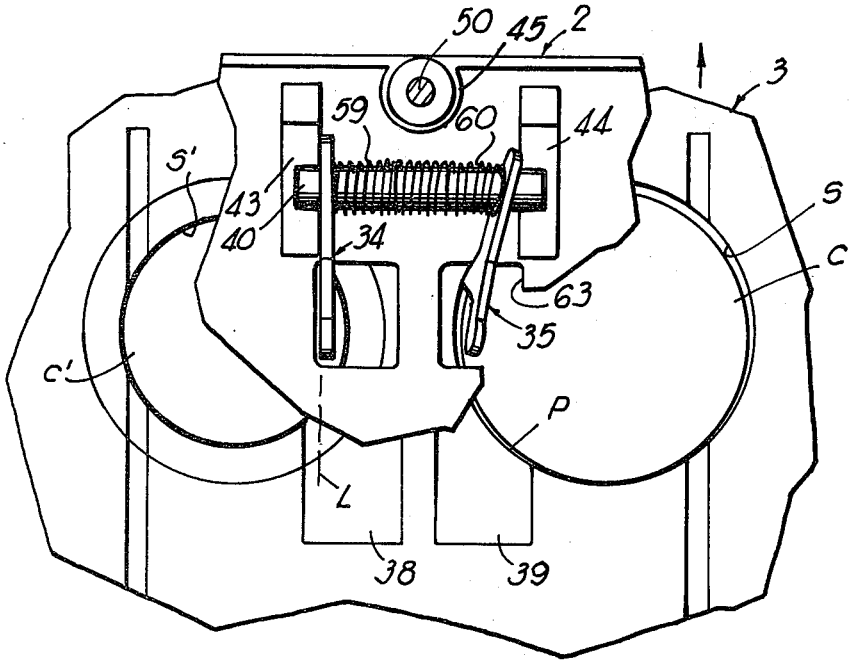

Because of the aforesaid loose anchoring engagement between the dogs 34 and 35 and the pin 40 and the biasing means 59 the dogs are permitted not only to tilt out of the normal plane in which they lie as aforesaid, but also to swing laterally with respect to the aforesaid normal line of engagement with the bottom surface 30 of the coin slide 3. This is illustrated in FIG. 7 with respect to the dog 35 and the action illustrated in FIG. 7 materially enhances the effectiveness of the dog, as will now be described. In FIG. 7, an undersize coin C is present in the socket S and therefore provides a peripheral gap between the coin and the socket, as illustrated. On the other hand, the socket S' has deposited therein a correct coin as illustrated by C'. Thus, whereafter the dog 34, and more especially the tip 36 thereof has moved along the line L illustrated in FIG. 6 and has, at the intersection of such line with the socket S' passed directly on to the underside of the properly size coin C' and thus has neither tilted nor shifted laterally with respect to such line, the tip of the dog 35 moving along the line L' will drop into the peripheral gap created between the undersize coin C and the socket S and, upon continued movement of the slide will tilt out of its normal plane as illustrated in FIG. 7 and will also shift laterally such that the tip follows the gap and, in the process, to shift the coin C within the socket S such that when the tip of the dog 35 reaches a position (approximately at the point P illustrated in FIG. 7) after having "followed" the aforesaid gap and shifted the coin C by penetrating deeply into said gap, further inward sliding motion of the coin slide 3 is arrested. A further function performed by the gauging dogs 34 and 35, when a washer of correct size (diameter) is encountered and which for some reason has passed the ring dogs 10 and 11, is to penetrate into the washer opening and function, instead of in the gauging manner, as a ring dog. It should be noted that in this position, i.e., when the tip 37 has reached the point P in FIG. 7, the dog 35 will have once again been shifted laterally essentially back to its original position as illustrated in FIG. 6. To facilitate this following and penetration, the essentially V-shaped tips 36 and 37 of the dogs are beveled as indicated at 61 and 62, see particularly FIG. 5. It should be noted also that the dog 35 in the above described motion arresting action, cannot be shifted laterally from the line in the opposite direction when it reaches the point P because the dog will ultimately, if necessary, jam against the inner side 63 of the opening 33 as illustrated in FIGS. 6 and 7.

Figure 4:
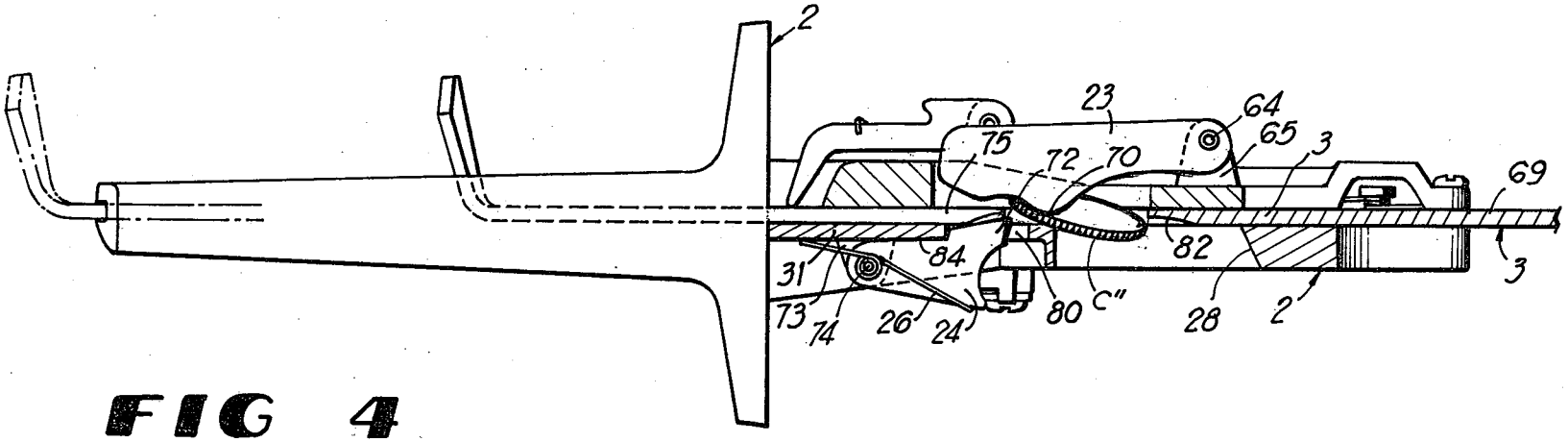
FIG. 4 is a vertical section taken through part of the coin chute mechanism and illustrating the coin stripping mechanism.

Insofar as the mechanism for stripping the coin off an adhesive strip is concerned, reference is had more particularly to FIG. 4. As illustrated therein, the spring biased dog member 23 is pivotally anchored by means of a suitable pin 64 to ears 65 carried by the frame 2, see also FIG. 1. The biasing means 25 are anchored or wrapped about respective pivot pins 64 for the two dogs 23, one end of each as indicated at reference character 66 bearing upon the frame 2 and the opposite end engaging over and bearing upon a portion of the respective dogs 23 remote from and forwardly spaced relative to the pins 64, as shown.

The floor portion 31 is provided with additional openings 80 and 81 (see FIGS. 3 and 4) which allow the respective tips 72 of the two dogs 24 to engage against the bottom surface of the coin slide 3 as the coin slide is being pushed in, ultimately to engage and pass beyond the coin in the coin opening and then to enter the recess grooves 75 and 76 (see FIG. 5). In the return direction of the coin slide 3, after the coins have dropped, the tips 72 of the dogs 24 enter the ramp grooves 82 and 83. To prevent excessive penetration of the tips 72 into the coin openings, they are constructed to bottom against the floor portion at 84 as shown in FIG. 4.

The two dogs 23 are urged downwardly through their respective slots 67 and 68 into engagement with the top surface 69 of the coin slide 3 until, at the discharge position of a coin, the noses 70 of these dogs bear directly upon the associated coin such as that illustrated as C″ in FIG. 4.

Thus, even if a coin C″ has been taped to the coin slide 3, the corresponding dog 23 will tend to push it downwardly as is illustrated in FIG. 4 so that when the slide 3 fully reaches the position at which the coin should have been discharged, the tip 72 of the abutment dog 24 will have dropped behind the coin C″. Thus, if the coin C″ does not drop and the slide is subsequently attempted to be withdrawn, the coin will abut against the tip 72 and, in the process of slide withdrawal, will be either stripped from the tape which is attempting to hold it from dropping into the coin deposit mechanism disposed below the opening 29, or the slide will be prevented from further withdrawal. In any event, the taping of coins is thwarted. Each dog 24 is pivotally anchored by means of a suitable pin 74 to ears 73, as dogs 23 are pivotally anchored to ears 65, and as mentioned before, each dog 24 has an associated spring biasing means 26 which, similar to the spring biasing means for the dogs 23, is wrapped about pivot pin 74.

What is claimed is:

1. In a coin chute having a frame defining a coin-supporting surface, a slide movable over said surface and having at least one opening therein to define, with said surface, a coin socket for transporting a coin received therein along a path on said surface from an initial position to a coin discharge position, said surface having an opening at such discharge position to allow a coin to drop from the socket, the improvement which comprises:

coin diameter gauging means for sensing an undersize coin or a spurious coin with a hole in it in said socket as the coin is transported toward said discharge position and for arresting movement of said slide upon the sensing of an undersize coin or a spurious coin with a hole in it, said gauging means comprising a dog carried by said frame and having a tip engaging said slide, as the slide is moved, along a line which is within the widthwise confines of said path, means mounting said dog on said frame for normally maintaining said tip in a generally upright plane passing through said line while allowing said tip to tilt relative to said upright plane and to shift laterally across said surface with respect to said line, whereby when the slide is moved toward the discharge position, said tip actively seeks and penetrates deeply into any peripheral gap within said socket created by an undersize coin, or penetrates into the hole of a spurious coin with a hole in it and prevents further inward motion of the slide.

2. In a coin chute as defined in claim 1 wherein said slide is provided, at said opening, with a knock-out which when removed enlarges the diameter of said socket to accept a larger coin, said knock-out being so positioned that the path traveled by the coin socket created by its removal also contains said line within the widthwise confines thereof, whereby said dog because of its tilting and lateral shifting capabilities is also effective to seek out and penetrate deeply into any peripheral gap created by an undersize coin received in said socket when enlarged by removal of said knock-out.

3. In a coin chute as defined in claim 1 or 2 wherein said tip is essentially V-shaped and is beveled along an edge thereof to facilitate its ability to seek out and penetrate deeply into a peripheral gap created by an undersize coin.

4. In a coin chute as defined in claim 1 or 2 wherein said means mounting said dog comprises an anchor pin and an abutment member receiving said pin, and a spring element biased toward said abutment member, said dog being loosely anchored on said pin and engaged by said spring element against said abutment member whereby said tip normally lies in said plane and engages said slide along said line.

5. In a coin chute as defined in claim 4 wherein said tip is essentially V-shaped and is beveled along an edge thereof to facilitate its ability to seek out and penetrate deeply into a peripheral gap created by an undersize coin.

* * * * *